United States Patent [19]

Hinchcliffe et al.

[11] Patent Number: 4,898,187

[45] Date of Patent: Feb. 6, 1990

[54] CIGARETTE MANUFACTURE

[75] Inventors: Dennis Hinchcliffe, London, England; Francis A. M. Labbe, Neuilly-sur-Seine, France; Desmond W. Molins, London, England; Paul R. Wiese, London, England

[73] Assignee: Molins PLC, London, United Kingdom

[21] Appl. No.: 246,676

[22] Filed: Sep. 20, 1988

Related U.S. Application Data

[62] Division of Ser. No. 909,234, Sep. 19, 1988, Pat. No. 4,785,831.

[30] Foreign Application Priority Data

Aug. 22, 1984 [GB] United Kingdom ..... 8421320

[51] Int. Cl.[4] ..... A24C 5/60

[52] U.S. Cl. ..... 131/284; 131/31; 131/62; 131/79; 131/362

[58] Field of Search ..... 131/79, 280, 31, 62, 131/84.1, 309, 310, 352, 367, 364, 284

[56] References Cited

U.S. PATENT DOCUMENTS 4,619,276 10/1986 Albertson et al. ..... 131/31

*Primary Examiner*—V. Millin

*Attorney, Agent, or Firm*—Antonelli, Terry & Wands

[57] ABSTRACT

Loss of tobacco from the ends of cigarettes is reduced or prevented by applying foamed adhesive thereto. The foam may in general be blown onto the cigarette ends [(FIGS. 1, 2 and 4)] or may be "printed" onto the cigarette ends [(FIG. 3 and FIGS. 5 and 6)]. The expansion ratio of the foam in preferably at least 10:1, so that very little liquid adhesive is needed to contact a significant area of tobacco. Thus the liquid content of the adhesive may be readily absorbed into the tobacco so as not to create a drying problem. In a preferred example [(FIG. 1)] foam is supplied by a pipe [24] to fill apertures on a disc [20] from which measured quantities of foam are blown by an air jet from a pipe [28.] Suction is applied to the filter ends [10B] of the cigarettes via a manifold [18] and flexible seals [12C] to help in drawing the foam into the cigarettes.

12 Claims, 3 Drawing Sheets

Fig. 4.
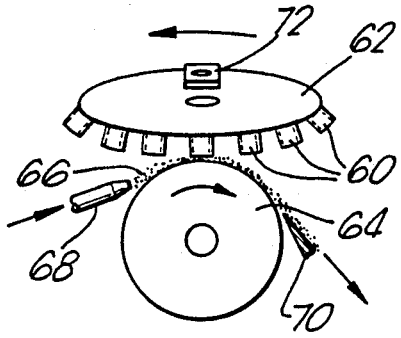
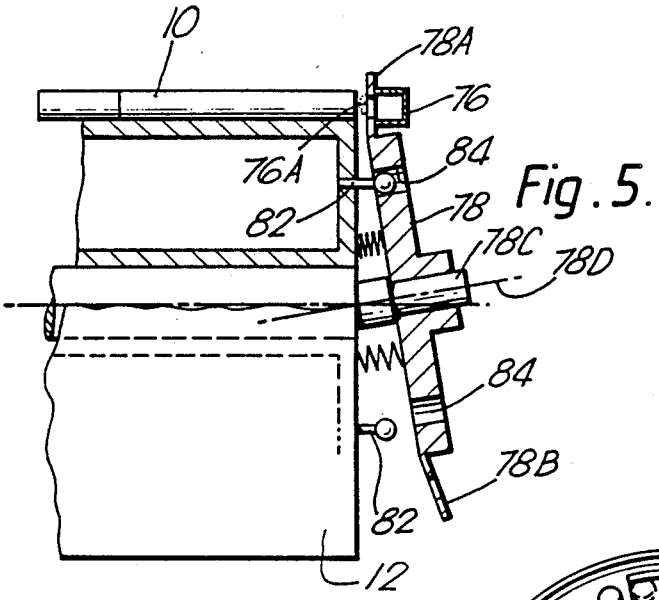
Fig. 5.
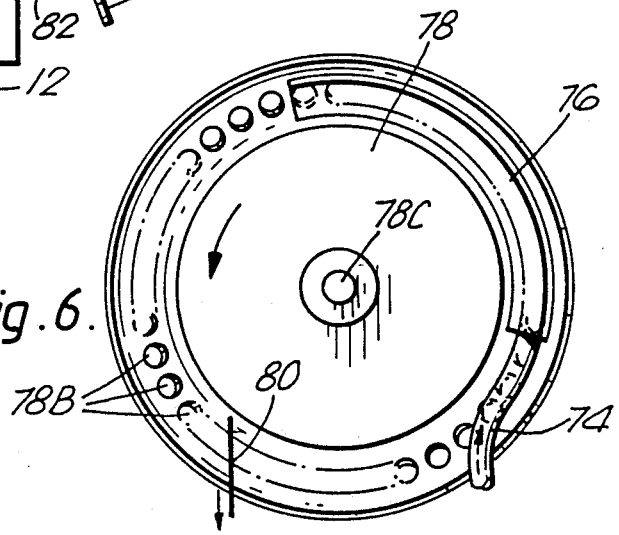
Fig. 6.

CIGARETTE MANUFACTURE

This is a division of application Ser. No. 909,234, filed Sept. 19, 1986, now U.S. Pat. No. 4,785,831.

While cigarettes are being conveyed between making and packing machines, there is a tendency for loose tobacco to fall out of the tobacco ends of the cigarettes. If an excessive amount of tobacco is lost, then the ends of some cigarettes can end up inadequately filled and such cigarettes need to be ejected in the cigarette packing machine as they could otherwise lead to customer complaints. In order to minimise the risk of "loose ends", it is common to arrange for the cigarette making machine to produce a cigarette filler stream with localised additional quantities of tobacco (so-called "dense ends") coinciding with the tobacco ends of the cigarettes, so that the ends are at least initially more dense than the remainder of the cigarettes. That procedure reduces the chances of some cigarettes ending up with loose ends, but it does not eliminate the possibility entirely and it does involve a sacrifice in terms of extra usage of tobacco.

It has previously been proposed to apply additional adhesive to the tobacco at the ends of the cigarettes to prevent or reduce loss of tobacco from the ends. However, no practical application of that principle has evolved.

According to one aspect of the present invention, adhesive is applied to the tobacco ends of cigarettes in the form of a foam. Preferably the foam has an expansion ratio of at least 10:1. In other words, the volume of the foam as a result of the bubbles of air or other gas in the adhesive is 10 times greater than that of the initial liquid adhesive. This allows the foam to contact a significant area of tobacco particles at the end of the cigarette without involving the use of so much liquid that drying of the adhesive becomes a problem. With an expansion ratio of at least 10:1 (and preferably at least 15:1), the amount of liquid involved can readily be absorbed by the tobacco in the cigarette and does not constitute a significant drying problem.

This invention will be described with reference to filter cigarettes which have only one tobacco end. However, it should be appreciated that the invention is also applicable to plain (non-filter) cigarettes and may be applied to both ends of such cigarettes.

The foam may in general be applied in measured quantities to the ends of the cigarettes by blowing or by use of a printing technique. In both cases, suction may be applied to the filter ends of the cigarettes to assist in drawing the foam into the tobacco ends.

Examples of apparatus according to this invention are shown in the accompanying drawings. In these drawings:

FIG. 4 shows a modification of the FIG. 3 apparatus viewed from the right.

FIG. 5 illustrates another arrangement for blowing foam onto the cigarettes;

FIG. 6 is a view from the right of the apparatus shown in FIG. 5; and

Figure 1:
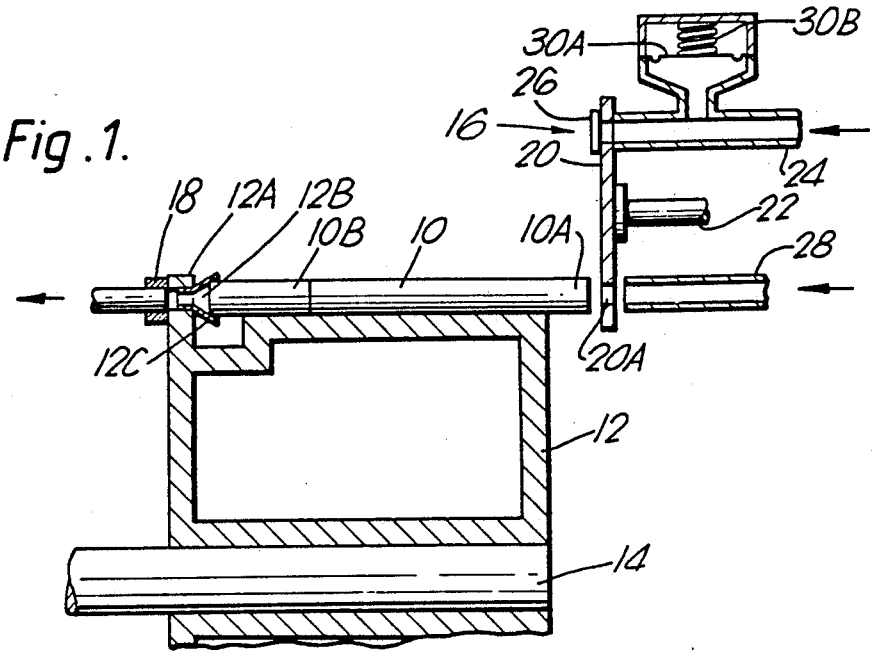
FIG. 1 is a diagrammatic fragmentary view of one apparatus for blowing the foam into the cigarettes.

FIG. 1 shows filter cigarettes 10 being conveyed by a fluted drum 12 mounted on a shaft 14. A measured quantity of foam is applied to the tobacco end 10A of each cigarette by a device 16 while suction is applied to the filter end 10B via a stationary suction pad 18 which bears against a flange 12A of the drum 12. Suction is transmitted to the cigarette through a passage 12B in the flange via a flexible conical seal 12C. In order to make sealing contact with the corresponding seal 12C, each cigarette may be pressed against the seal by a device (not shown) upstream of the foam-applying device 16 by engagement with the tobacco end of the cigarette; alternatively, each cigarette may be sucked onto the seal by suction applied through the manifold 18.

The device for applying measured quantities of foam comprises a disc 20 mounted on a shaft 22 and having circumferentially spaced apertures 20A which register with successive cigarettes 10. Each aperture 20A is filled with foam supplied by a pipe 24 while a stationary closure plate 26 covers the reverse side of the aperture. While each aperture is aligned with one of the cigarettes 10, a pulse of air is applied through a pipe 28 producing an air jet or a group of substantially parallel jets which blow the foam from the aperture 20A onto the adjacent cigarette end.

It is possible for the apertures 20A in the disc 20 to be at the same pitch as the cigarettes on the drum 12. However, that would involve significant intervals during which no foam can flow from the pipe 24 into apertures 20A. During such intervals it is necessary to buffer the flow of foam and for that purpose a bypass arrangement is provided, consisting of a diaphragm or other movable part 30A backed by a spring 30B. The buffer capacity needed for this purpose can be reduced or possibly eliminated if the pitch of the apertures 20A is reduced so that the apertures 20A are almost adjacent to one another. In that case the circumferential speed of the apertures 20A would be correspondingly reduced in comparison with the circumferential speed of the cigarettes.

FIG. 1 for convenience shows foam being supplied to the apertures 20A at a position 180° offset from the air pipe 28. In practice, the foam may be supplied to the apertures 20A immediately upstream of the pipe 28 to minimise the time during which the foam can start to degrade (i.e. return to its liquid form).

Instead of being mounted on the shaft 22, the disc 20 (with an appropriately larger diameter) may be mounted on an extension of the shaft 14, i.e. coaxially with the drum 12. In this case air may blow continuously from the pipe 28, whereas it is preferably pulsed in the case of the arrangement shown in FIG. 1, each pulse coinciding with the arrival of a cigarette and aperture 20A in alignment with the pipe 28.

By way of example, each aperture 20A may have a diameter of 5.0 to 5.5 mm. It is desirable to ensure that the foam does not come into contact with the cigarette wrapper. That can be achieved by making the diameter of the aperture significantly smaller than the cigarette diameter which is typically 8 mm. The thickness of the disc may, for example, be 3 mm.

The internal diameter of the pipe 24 may be the same as, or slightly less than, that of the apertures 20A. Alternatively, the outlet end of the pipe may be in the form of a number of parallel small-diameter nozzles. In the former case the air pressure should be relatively low, for example 0.25 to 0.5 pounds per square inch (1725 to 3450 Pa) to avoid splashing of the cigarette wrapper with adhesive on account of an excessive air flow. In the latter case (with multiple nozzles) a higher air pressure can be used.

In order to minimise friction between the disc 20 and the tube 24 and plate 26, the disc 20 may be made of or coated with a low-friction plastics material such as ultra-high molecular weight polyethylene.

The adhesive used in the formation of the foam may, for example, be a sodium salt of carboxymethyl cellulose (commonly abbreviated to NaCMC). For example, the adhesive may be used as a 3% solution in water. A small quantity of surfactant, for example 1%, is added as a foaming agent to facilitate foaming.

In one experiment foam was formed from a water-based solution including 3% of a low-viscosity form of carboxymethyl cellulose (identified as Courlose F.8.P by the manufacturer, Courtaulds PLC) plus 1% of a surfactant identified as Perlankrol DSA by its manufacturer, Lankro of Manchester M30 OBH, England. The optimum blow ratio we found to be 16:1, which gave adequate bonding to a depth of about 1.5 mm into the end of the cigarette, while using a small enough quantity of water to allow reasonably quick drying.

In average atmospheric conditions it was found that the adhesive nevertheless took a few minutes to dry sufficiently to fully secure the tobacco in the ends of the cigarettes. In order to reduce the drying time, the adhesive mixture may be heated (e.g. to between 60 and 70 degrees C) before entering the foaming equipment; heating moreover facilitates the use of a higher blow ratio, which reduces the drying time by reducing the amount of water in a given volume of foam.

Figure 2:
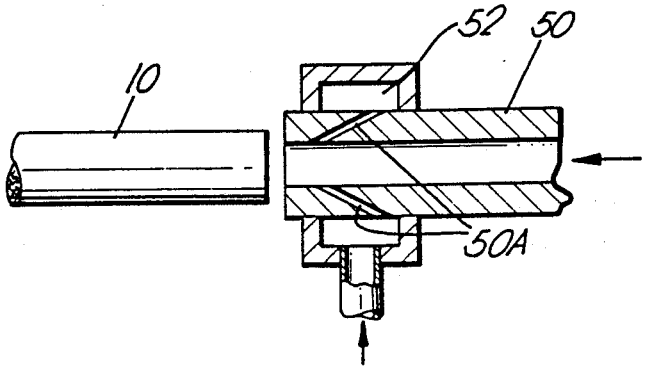
FIG. 2 illustrates diagrammatically an alternative arrangement for blowing foam into the cigarettes.

FIG. 2 shows an alternative arrangement for blowing measured quantities of foam onto cigarettes 10 carried by a drum which may be similar to the drum 12 in FIG. 1 and may include a similar provision for sucking the foam into the cigarettes.

Foam in this case is supplied through a pipe 50 which has, near its outlet end, a number of circumferentially spaced passages 50A inclined so that air blown into those passages from a manifold 52 propels a measured quantity towards the end of the adjacent cigarette Air pressure pulses are supplied to the manifold 52 at a frequency corresponding to the frequency at which cigarettes pass the pipe 50. With this arrangement it is not necessary to include a buffer such as that shown in FIG. 1.

There may be two or more circumferentially spaced pipes 50. Each may supply a part of the total foam required for each cigarette. Alternatively, two pipes 50 may for example be pulsed at half the frequency to supply foam to alternate cigarettes.

As a result of the inclination of the passages 50A in FIG. 2, each blob of foam propelled from the pipe 50 tends to become streamlined (approximately pear-shaped), being stretched in its direction of movement and being slimmed laterally by the action of the converging air jets. This assists the penetration of each blob of foam into the corresponding cigarette while reducing the risk of adhesive coming into contact with the cigarette wrapper.

A similar effect can be achieved in the arrangement shown in FIG. 1, that is by producing a number of converging air jets (or an equivalent annular air jet) in the member 28 to blow successive blobs of foam from the apertures 20A. As in FIG. 2 the point of convergence of the air jets or annular curtain preferably lies substantially at the centre of the leading face of each blob before commencement of its propulsion by the air jet or jets, thus imparting the greatest velocity to the leading end of each blob.

Figure 3:
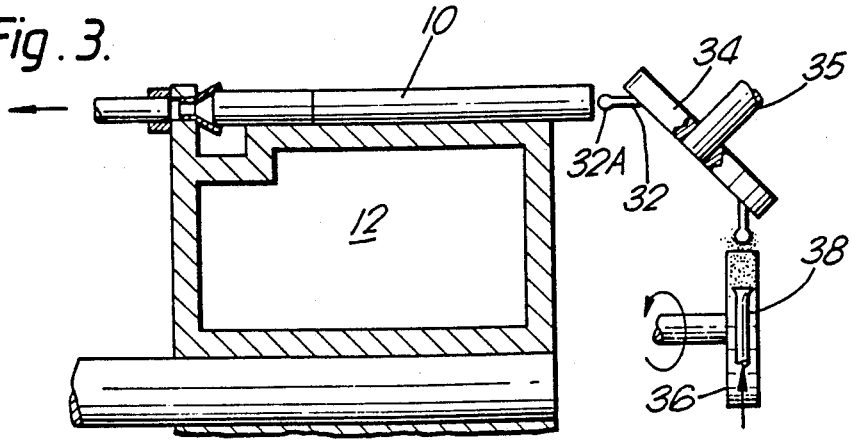
FIG. 3 illustrates diagrammatically an arrangement for printing foam onto the cigarettes.

FIG. 3 shows cigarettes 10 being conveyed by a drum 12 which may be similar to the drum 12 shown in FIG. 1 and may include the same suction provision. Measured quantities of foam are printed onto the cigarette ends by pins 32 mounted at circumferentially spaced positions on a disc 34. Each pin has a spherical end 32A, for example of 6mm diameter. Foam is picked up from a continuous ribbon of foam formed on a wheel 36 by a nozzle 38.

The disc 34 is carried by a shaft 35 set at 45° to the axis of the drum 12. consequently, the closest point between each pin 32 and the corresponding cigarette 10 occurs, as shown in FIG. 3, where foam is to be transferred to the cigarette from the pin.

FIG. 4 shows a modification of the apparatus shown in FIG. 3. Each pin 60 on an inclined disc 62 (corresponding to disc 34 in FIG. 3) is set at 45 degrees to the disc 62 and is hollow so that a measured quantity of foam enters the pin as it approaches a wheel 64. A ribbon of foam 66 is formed on the wheel 64 for that purpose by a nozzle 68, and excess foam remaining on the wheel is removed by a scraper 70 for return to the source of adhesive. When each pin 60 comes into alignment with a corresponding cigarette, the foam contained in it is blown out by air supplied via a manifold 72.

FIGS. 5 and 6 show another arrangement in which the foam is printed onto the ends of cigarettes 10 carried by a drum 12. The foam is supplied by a pipe 74 to an arcuate manifold 76 lying in contact with a thin peripheral portion 78A of a disc 78. At regular intervals corresponding to the pitch between cigarettes 10 on the drum 12, there are apertures in the peripheral portion 78A. Foam gently exudes through the apertures and produces beads 76A which project from the left of the disc so as to be applied to corresponding cigarette ends.

The disc 78 rotates about an axis 78D which is inclined to the axis of the drum. Accordingly, each aperture in the peripheral portion 78A of the disc gradually moves closer to the drum to apply the foam adhesive, and then gradually moves away from the drum. Any adhesive left on the disc is scraped off and fed back to the source of the foam by a pair of scrapers 80 engaging opposite faces of the portion 78A of the disc.

The apertures 78B in the disc may be approximately 4 to 5 mm in diameter. Alternatively, each aperture may be replaced by a cluster of smaller apertures, depending upon the foam pressure and on the degree to which the foam spreads on exuding out of the apertures.

Suction may be applied to the filter ends of the cigarettes as described above.

The disc 78 is rotatably mounted on a shaft **78*c* and is driven by a number of pins 82 extending axially from the end of the drum 12 and engaging in corresponding apertures 84 in the disc 78. Thus the disc 78 rotates at the same speed of the drum 12**.

Figure 7:
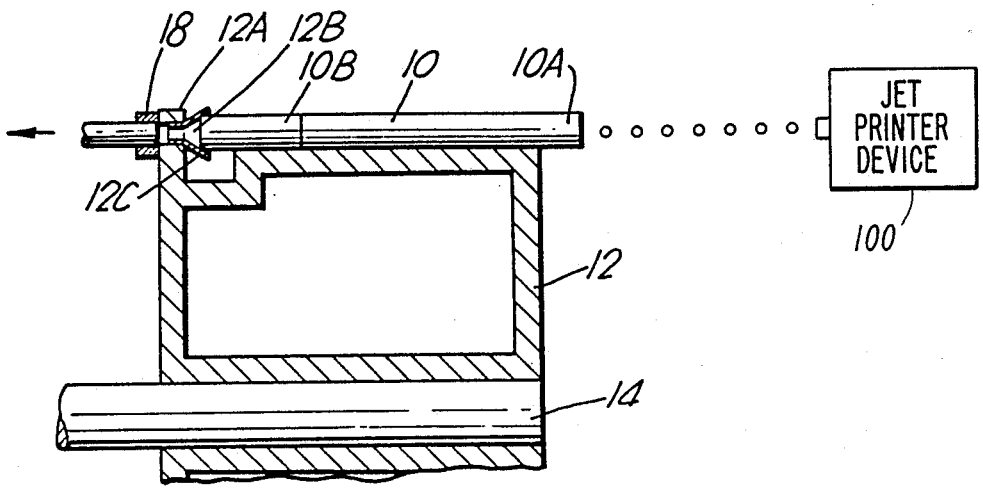
FIG. 7 is a diagrammatic view of an apparatus using a jet printer device to apply adhesive to the cigarette.

A further possibility is that, instead of being applied as foam, the adhesive may be applied in small measured quantities in liquid form by a device 100 similar to an ink jet printer as shown in FIG. 7. Such a device is used to apply a suitable pattern of adhesive to the end of each cigarette as it moves past, the ends of the cigarettes being arranged to move past the "printer" nozzle, closely spaced therefrom, so that measured quantities of adhesive can be accurately squirted onto each cigarette end.

We claim:

1. A method of treating cigarettes in which the cigarettes are conveyed sideways past nozzle means, spaced from the tobacco ends of the cigarettes and directed thereto, including the steps of supplying liquid adhesive to the nozzle means and operating the nozzle means while each successive cigarette is aligned therewith and spaced therefrom to project a measured quantity of adhesive onto the end of each cigarette from the nozzle means.

2. A method according to claim 1 in which the nozzle means is operated to apply a pattern of measured quantities of adhesive to the end of each cigarette.

3. A method according to claim 1, wherein said nozzle means comprises a jet printer device.

4. A method of treating cigarettes in which the cigarettes are conveyed sideways past nozzle means directed towards the tobacco ends of the cigarettes, including the steps of supplying liquid adhesive to the nozzle means and operating the nozzle means while each successive cigarette is aligned therewith to project a measured quantity of adhesive onto the end of each cigarette from the nozzle means, and in which, while adhesive is being projected into one end of each cigarette, suction is applied to the other end of the cigarette to promote entry of the adhesive into the cigarette.

5. Apparatus for treating cigarettes to reduce the loss of tobacco from tobacco ends, comprising a conveyor for conveying cigarettes sideways along a predetermined path, a source of liquid adhesive, and nozzle means connected to the source and mounted at a position adjacent to the said path but spaced from the cigarettes for directing a measured quantity of adhesive onto the tobacco end of each cigarette from the spaced position.

6. Apparatus according to claim 5, including means for operating the nozzle means a plurality of times while each cigarette is aligned therewith for applying a predetermined pattern of measured quantities of adhesive to the end of each cigarette.

7. Apparatus according to claim 5, wherein said nozzle means comprises a jet printer device.

8. A method of treating cigarettes in which the cigarettes are conveyed sideways past nozzle means directed towards the tobacco ends of the cigarettes, including the steps of supplying liquid adhesive to the nozzle means and operating the nozzle means while each successive cigarette is aligned therewith to project a measured quantity of adhesive onto the end of each cigarette from the nozzle means, and applying suction to each cigarette to produce an air flow into the tobacco end thereof and thus promote the entry of the liquid adhesive into the tobacco end.

9. A method according to claim 8 in which the nozzle means is operated to apply a pattern of measured quantities of adhesive to the end of each cigarette.

10. A method according to claim 8, wherein said nozzle means comprises a jet printer device.

11. Apparatus for treating cigarettes to reduce the loss of tobacco from tobacco ends, comprising a conveyor for conveying cigarettes sideways along a predetermined path, a source of liquid adhesive, and nozzle means connected to the source and mounted adjacent to the said path for directing a measured quantity of adhesive onto the tobacco end of each cigarette, and including means for applying suction to each cigarette to produce an air flow into the tobacco end thereof and thus promote the entry of the liquid adhesive into the tobacco end.

12. Apparatus according to claim 11, wherein the suction means comprises means for applying suction to the end of the cigarette remote from the tobacco end to which adhesive is applied.

* * * * *